US008033966B2

(12) United States Patent
Ayoub

(10) Patent No.: US 8,033,966 B2
(45) Date of Patent: Oct. 11, 2011

(54) SAFETY DEVICE FOR EXERCISE RESISTANCE BANDS

(76) Inventor: Victor R. Ayoub, Fort Lee, NJ (US)

( * ) Notice: Subject to any disclaimer, the term of this patent is extended or adjusted under 35 U.S.C. 154(b) by 0 days.

(21) Appl. No.: 12/426,278

(22) Filed: Apr. 19, 2009

(65) Prior Publication Data

US 2010/0267529 A1 Oct. 21, 2010

(51) Int. Cl.
*A63B 21/02* (2006.01)

(52) U.S. Cl. ..... 482/121; 482/74; 482/91

(58) Field of Classification Search ..... 482/121, 482/74, 91
See application file for complete search history.

(56) References Cited

U.S. PATENT DOCUMENTS 3,193,288 A * 7/1965 De Spain Le Vell et al. . 482/129
3,826,492 A * 7/1974 Hagan ..... 472/118
4,060,240 A * 11/1977 Dunston ..... 482/131
4,073,490 A * 2/1978 Feather ..... 482/129
4,109,905 A * 8/1978 Meier ..... 482/55
4,200,281 A * 4/1980 Wang ..... 482/123
4,245,839 A * 1/1981 Trent ..... 482/92
4,257,592 A * 3/1981 Jones ..... 482/131
4,335,875 A * 6/1982 Elkin ..... 482/74
4,372,553 A * 2/1983 Hatfield ..... 482/105
4,441,707 A * 4/1984 Bosch ..... 482/131
4,659,078 A * 4/1987 Blome ..... 482/110
4,909,505 A * 3/1990 Tee ..... 482/129
4,974,836 A * 12/1990 Hirsch ..... 482/40
5,076,576 A * 12/1991 Johnston ..... 482/95
5,352,174 A * 10/1994 Mason et al. ..... 482/129
5,472,394 A * 12/1995 Michaelson ..... 482/74
5,514,058 A * 5/1996 Buoni et al. ..... 482/124
5,514,059 A * 5/1996 Romney ..... 482/124
5,569,169 A * 10/1996 Lewark, Sr. ..... 601/134
5,643,159 A * 7/1997 Iavarone ..... 482/125
5,653,665 A * 8/1997 Neeley ..... 482/106
5,743,838 A * 4/1998 Willis ..... 482/124
5,746,687 A * 5/1998 Vial et al. ..... 482/126
5,776,041 A * 7/1998 Fisher ..... 482/125
5,873,805 A * 2/1999 Ayres et al. ..... 482/125
5,885,196 A * 3/1999 Gvoich ..... 482/125
5,941,802 A * 8/1999 Kiser ..... 482/92
5,984,792 A * 11/1999 Clark ..... 472/118
5,993,361 A * 11/1999 Paoli et al. ..... 482/121
6,007,463 A * 12/1999 Wells et al. ..... 482/126
6,120,424 A * 9/2000 Arline ..... 482/121
6,142,919 A * 11/2000 Jorgensen ..... 482/121
6,203,476 B1 * 3/2001 Wang et al. ..... 482/121
6,238,324 B1 * 5/2001 MacMillan ..... 482/121
6,361,516 B1 * 3/2002 Hamel ..... 602/27
D455,185 S * 4/2002 Karadimas ..... D21/692
6,390,957 B1 * 5/2002 Knight ..... 482/79
6,482,137 B2 * 11/2002 Walker ..... 482/110
6,662,651 B1 * 12/2003 Roth ..... 73/379.02
6,751,816 B1 * 6/2004 Wechsler ..... 5/417
6,921,357 B2 * 7/2005 Basting ..... 482/121

(Continued)

*Primary Examiner* — Glenn Richman
(74) *Attorney, Agent, or Firm* — Lawrence C. Edelman

(57) ABSTRACT

An elastic resistance band for use in an exercise device. The resistance band comprising a center portion having opposed ends and having a shape and comprised of a material which presents a substantial friction against air, so to create a wind resistance effect which slows down movement of the center portion when the center portion is forced to move through air, and an elastic band portion attached to each of the opposed ends of the center portion. The elastic band portions having at their free ends means for attaching the elastic resistance band to an exercise device.

22 Claims, 4 Drawing Sheets

U.S. PATENT DOCUMENTS

| | | | | |
|---|---|---|---|---|
| 7,041,040 | B2 * | 5/2006 | Dovner et al. | 482/124 |
| 7,104,935 | B2 * | 9/2006 | Matsuoka | 482/124 |
| 7,137,935 | B2 * | 11/2006 | Clarke et al. | 482/123 |
| 7,175,574 | B2 * | 2/2007 | Carmel et al. | 482/124 |
| 7,210,177 | B1 * | 5/2007 | John | 5/417 |
| 7,578,775 | B2 * | 8/2009 | Terry | 482/126 |
| 7,766,805 | B1 * | 8/2010 | Horne | 482/124 |
| 2002/0137609 | A1 * | 9/2002 | Rosati | 482/126 |
| 2003/0027698 | A1 * | 2/2003 | Matsuoka | 482/124 |
| 2006/0084556 | A1 * | 4/2006 | Payne | 482/121 |
| 2007/0213186 | A1 * | 9/2007 | Longo | 482/121 |
| 2007/0287614 | A1 * | 12/2007 | Fuller | 482/121 |
| 2008/0009398 | A1 * | 1/2008 | Grisdale | 482/124 |
| 2008/0081747 | A1 * | 4/2008 | Mok | 482/121 |
| 2008/0096737 | A1 * | 4/2008 | Ayoub | 482/107 |
| 2009/0137371 | A1 * | 5/2009 | Fuller | 482/122 |

* cited by examiner

SAFETY DEVICE FOR EXERCISE RESISTANCE BANDS

CROSS-REFERENCE TO RELATED APPLICATIONS

This application claims priority under 35 USC 120 of prior U.S. Provisional Patent Application U.S. Ser. No. 60/617,832, filed Apr. 18 2008. The entire disclosure of this patent application is incorporated herein by reference in its entirety.

BACKGROUND OF THE INVENTION

1. Field of the Invention

This invention relates generally, to exercise devices and more particular to the addition of a safety device for modifying the exercise resistance elastic bands.

2. Description of the Prior Art

Exercise devices of the type having elastic resistance bands are well know, see for example the exercise bar of U.S. Pat. No. 4,059,265. One drawback of an exercise device of this type having an elastic exercise band is the potential for a snap-back effect if the band breaks or slips off of a retaining position while it is stretched, which snap-back effect can cause the band 10 to hit the user or people nearby, thereby causing a severe bodily injury, as well as property damage.

SUMMARY OF THE INVENTION

The new fail-safe design for the exercise band greatly lowers the risk of snap back or recoil injury to a user of an exercise device which includes an elastic exercise resistance band. In the present invention, an element is added to the band upon which element a resistance effect of wind or air can act, so as to form a type of parachute or air brake which will slow or stop the snap back effect of the resistance band in the event of a failure or unwanted release of the band from a mount.

The new design for the exercise band also allows for a better/more secure and comfortable stance when the band is held in place by the user's feet or foot, or for a more secure mounting position when the band is held in place by a mount, such as a door mount. More specifically, the new element added to the improved resistance band increases the surface area of the center portion of the band, which new element has a texture much different than a conventional resistance band, and which surface area has a texture which greatly increases a frictional characteristic of the center section of the improved resistance band, as compared with the prior art.

Furthermore, the new design for the exercise resistance band eliminates the need for a separate component to mount the exercise band to a door and also the method by which the design for the exercise band does mount to a door greatly lowers the risk of band snap. Additionally, the mounting techniques possible with the new design, greatly reduces the possibility of the mounting to mar the mounting surface, such as a door frame, as commonly occurs with door mounts for the currently used resistance band exercise devices.

Even further, due to the shorter lengths needed for the resistance portion of the exercise band, the potential for snap back injury due slippage or failure of any portion of the band, is inherently reduced.

Because of the reduced potential for injury provided by the improved design, users of exercise devices having a resistance band of this new type, in general will feel more confident to use exercise devices, and thus help ensure the completion of regularly scheduled exercise,

BRIEF DESCRIPTION OF THE DRAWINGS

The accompanying drawings, which are incorporated herein and constitute part of this specification, illustrate embodiments and details of the invention, and, together with the general description given above and the detailed description given below, serve to explain the features of the invention.

DETAILED DESCRIPTION OF THE INVENTION

Figure 1:
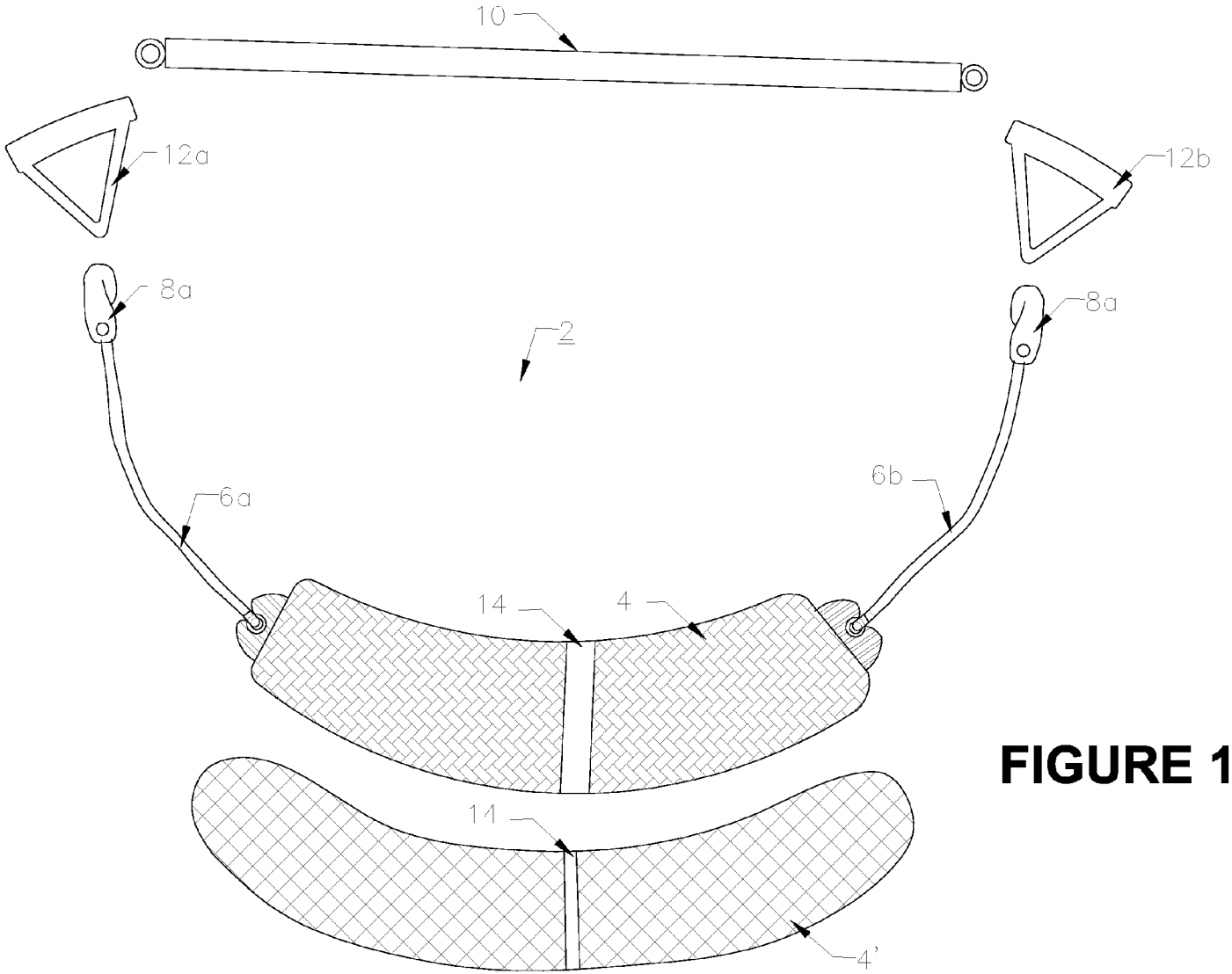
FIG. 1 illustrates an exercise resistance band constructed in accordance with one embodiment of the invention, and alternative attachment devices.
Figure 2:
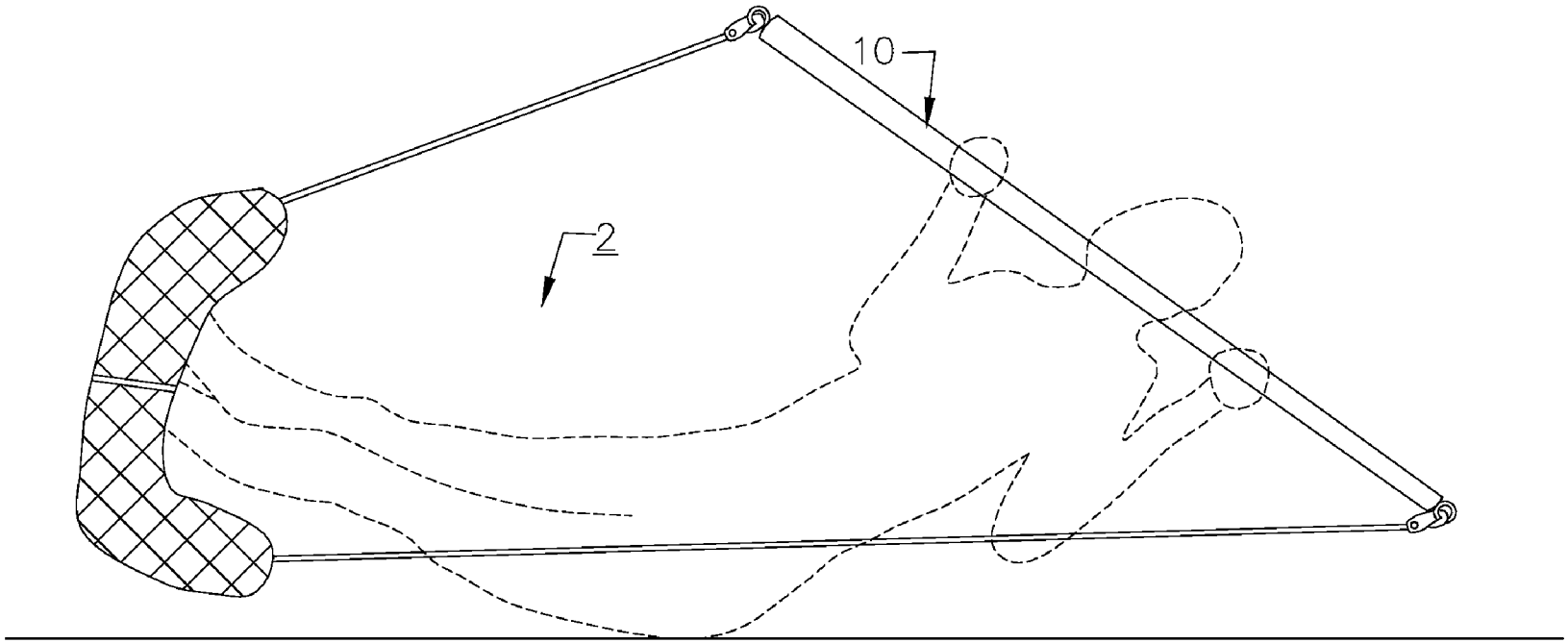
FIGS. 2, 4, 5 and 6 illustrate the exercise resistance band of FIG. 1 connected to a bar-type user gripping device.
Figure 3:
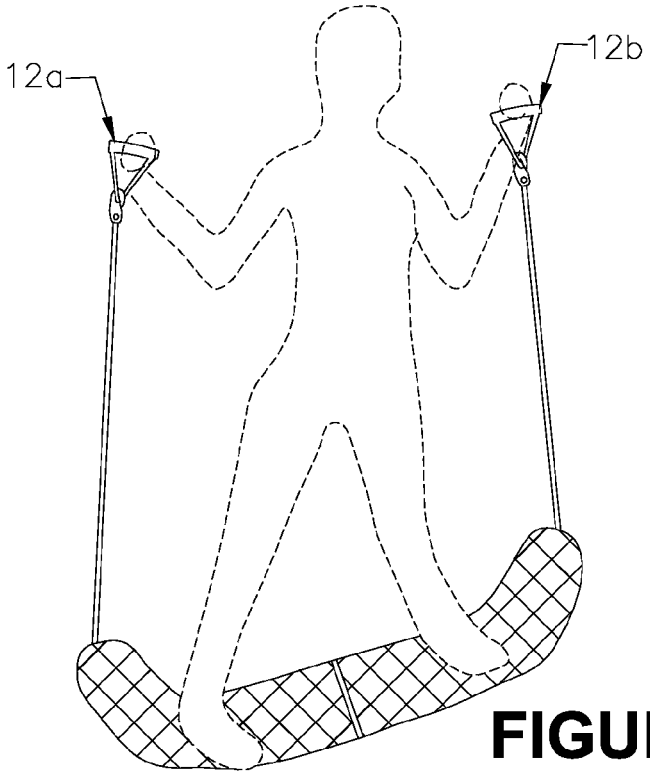
FIG. 3 illustrates the exercise resistance band of FIG. 1 connected to individual handle-type user gripping devices.
Figure 4:
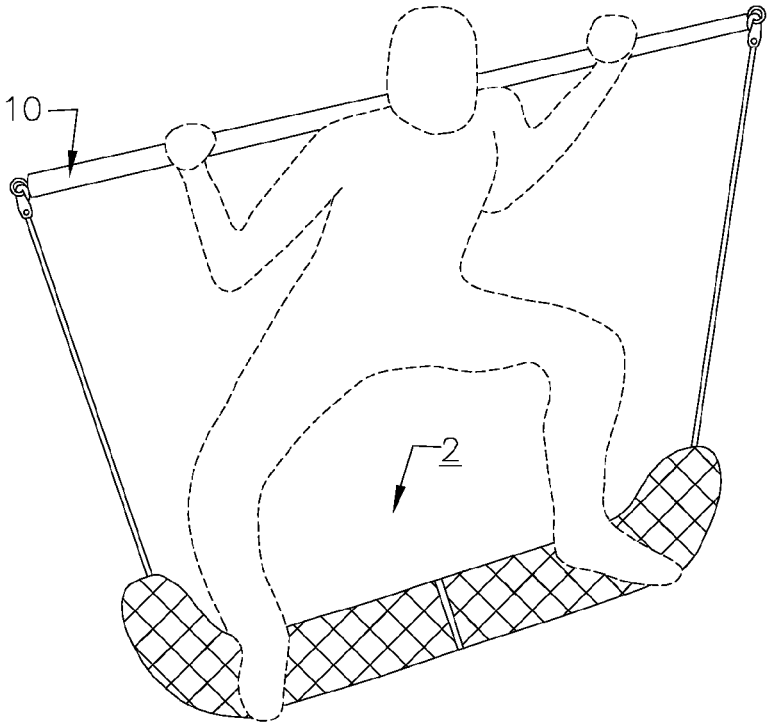

FIG. 1 illustrates the inventive resistance band exercise device 2. The resistance band exercise device 2 includes a portion 4 in the center which may be referred to as a safety net or Para-mount section. It is the device portion 4 that provides the wind resistance which will substantially reduce or eliminate the snap back effect in the event of a mount or placement failure causing an unwanted release of the center portion of the band 2. This device portion 4 can be made of a netting type of nylon material (as shown by element 4'), or may comprise an air impervious material 4, such as used in parachutes, and have a shape of approx 30" in length and 6"-12" in width so as to catch the air in the event the band snaps back. The device portion 4 is gathered at its opposing ends so as to form an overall cupped or parachute type of shape for the center section of the band 2, and the ends are securely attached to approximately 18" to. 24" inches of elastic band material 6*a* and 6*b*. Small clips or fastners 8*a* and 8*b* are secured at each of the remote ends of the bands 6*a* and 6*b*, respectively, for attaching the improved band 2 to any type of exercise equipment which uses a resistance band. For example, typically, such a resistance band is attached to an exercise bar 10 or handles 12*a* and 12*b* (FIGS. 2 and 4 show an embodiment of the invention where the inventive band 2 is used with an exercise bar 10, and FIG. 3 shows an embodiment of the invention where the inventive band 2 is used with handles 12*a* and 12*b*, respectively.)

Typically, the elastic band material 6*a* and 6*b* are formed of surgical tubing or other elastic, resistive material, such as "Thera-Bands"®. The band material is conventionally attached to a plastic clip or fastener, such as shown in FIG. 1, as well known by those of ordinary skill in this art. The opposite ends of the bands can be attached to the device portion 4 at a mounting hole/area formed at the opposite ends of device portion 4, by means of a loop knot attachment, as well known by those of ordinary skill in this art.

Additionally, in a further alternative embodiment of the invention device portion 4 includes a strip of flexible material 14 sewn or otherwise affixed to the center portion of device portion 4, which material aids in the mounting of the device portion 4 to a mounting device, such as a door, as will be described in greater detail with respect to FIG. 6.

Referring again back to FIG. 1, in that event that during the tension phase of the resistance band exercise device 2, the elastic bands 6*a* or 6*b*, or one of their mountings were to suffer a failure, the cupped or parachute shape of the device center portion 4 is designed so that the wind caused by the sudden release of the band, would cause the device center portion 4 to "bellow out" or stated another way, to "deploy" so that the wind caught by the device center portion 4 would greatly slow down the movement of the band, thereby greatly reducing or substantially eliminating the snap back effect. This effect is also proved with different materials being used for the device center portion 4, such as the parachute or netting material shown in FIG. 1.

As shown in FIGS. 2, 3 and 4, the present inventive resistance band exercise device 2 also allows for safe mounting and dismounting of an exercise device 2, for example under the feet or a foot of the user, by the fact that the center portion 4 creates a larger mounting area than if just the elastic band 6*a* or 6*b* itself were to be used to do the mounting. The safety increase results from the increased area of center portion 4 as well as the material from which it is constructed, as compared with the elastic material of the remainder of the band 2. More specifically, when center portion 4 is made of a mesh or even parachute material, the increased area of the material of center portion 4 provides for much more frictional contact between the center portion 4 and the underside of the user's feet, thereby making an unwanted release of the mounting extremely unlikely. Additionally, because the center portion 4 is substantially flat, as compared with the hard round structure of the resistance/elastic band surgical tubing, even if the user were to use the improved exercise device while being "barefoot" there would be no discomfort to the bottom of the user's foot, which the user would have suffered if they were using the prior art device due to standing on the hard round elastic tubing, since with the present invention, the user will have the soft/flat center portion 4 under his/her foot.

Furthermore, there would be no tendency for the elastic band material (such as surgical tubing) to "roll-out" from under the user's foot and cause an unwanted release, because the center portion 4 will lay flat under the user's foot. And even if an unwanted release were to occur during the tension phase of the elastic band material, due to the sudden and rapid movement during a "snap-back" action, the center portion 4 will "deploy" and the wind resistance effect caused by the sudden movement will greatly slow down the movement of the elastic band material, thereby reducing or substantially eliminating the snap-back effect.

Figure 5:
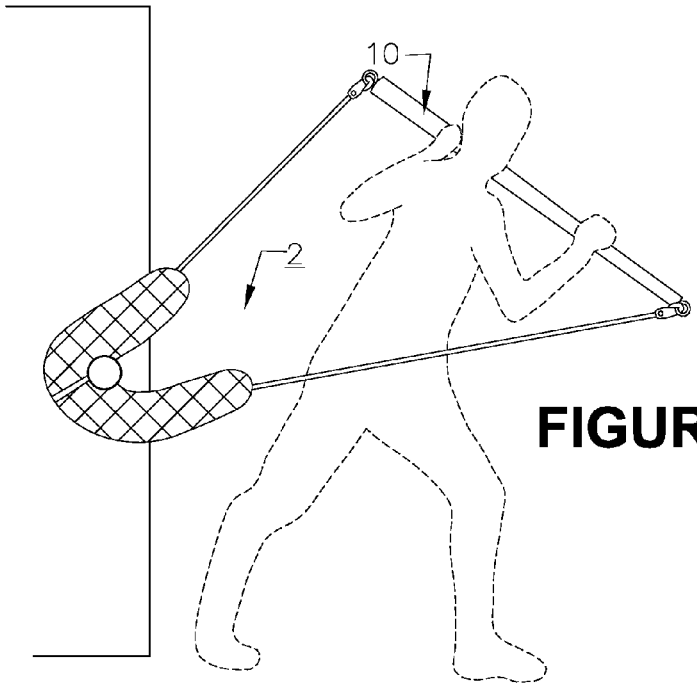

The same advantages of the invention apply with respect to door or frame mounted exercise resistance bands. Not only does the center portion 4 act as a safe mounting part of the exercise device, but it provides for a secure mount in a relatively fail-safe manner. As seen in FIG. 5, the mesh or parachute center portion 4 can simply be placed on the doorknob opposite the user to provide a door mount. Due to the increased width of the center portion 4, as well as its texture, it is very unlikely to "slip" off of a doorknob. Even in the unlikely event of an unwanted release of the center portion 4 from the doorknob mounting, the air resistance effect against the center portion 4 of mesh or chute material will substantially slow down the snap-back of the device 2, thereby greatly lower the risk and potential for injury to the user, a person standing nearby, and/or damage to property. Additionally, because the thickness of center portion 4 is so much less than the diameter of the conventional resistance band material (surgical tubing), the door can be even be closed so as to provide even extra safety for the mounting of the exercise device 2 to a door.

Figure 6:
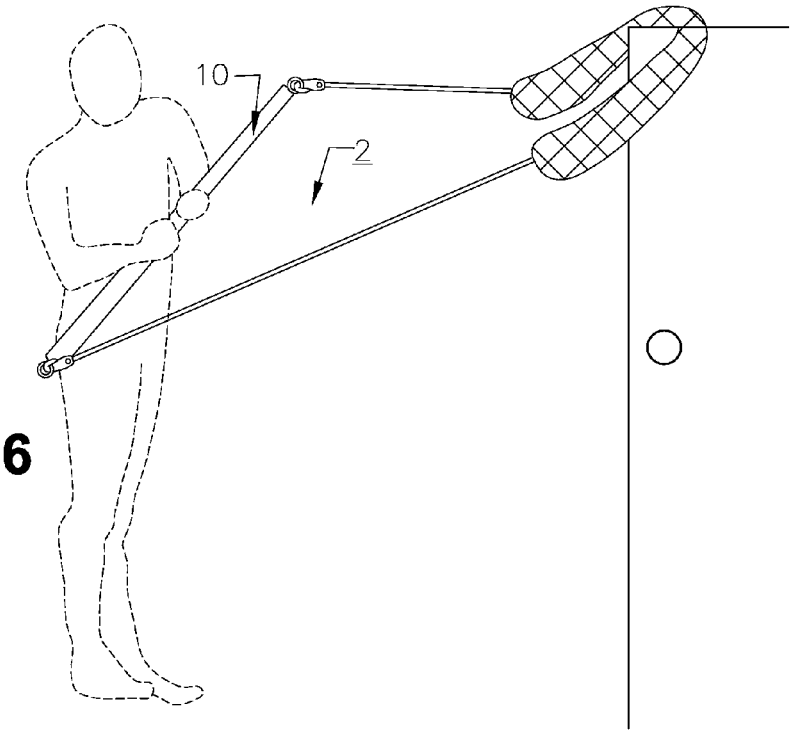

Additionally, when the center portion 4 is mounted to a door knob as seen in FIG. 5, or a door frame as seen in FIG. 6, it is less likely to damage or mar the door frame as seen commonly with current door mounts for such devices. In this regard, the center portion 4 of the present invention also includes center portion 14, as an added safety measure. Portion 14 is a strip of flexible material which reinforces and thickens the center portion 4, so that when mounted without the use of a doorknob as seen in FIG. 6, there is added resistance and thickness which help to avoid unwanted slippage from the doorframe.

In another user technique, instead of mounting the center portion 4 to a door or securing it under the user's feet, a trainer or partner standing opposite the user can grasp center portion 4 with his/her hands. In this technique, the center portion 4 provides a much more secure, comfortable (less abrasion) and allergy-free place for the trainer or partner to grab center portion 4. Another side benefit is that the trainer's hands don't smell like rubber or surgical tubing at the end of the day.

Thus, the present invention provides an extremely safe exercise resistance band, which is particularly appropriate for use by personal trainers, fitness centers, children and seniors.

While this invention has been particularly shown and described with references to preferred embodiments thereof, it will be understood by those skilled in the art that various changes in form and details may be made therein without departing from the spirit and scope of the invention. In fact, some such changes are already noted in this description (such as alternative materials for the center portion 4, alternative user grips (handles vs. bar) and alternative mounting arrangements. It should be realized that the above-noted changes are not exhaustive, and merely exemplary. Those skilled in the art will recognize, or be able to ascertain using no more than routine experimentation, many equivalents to the specific embodiments of the invention described herein. For example, center portion 4 can have different lengths and widths or be constructed of different materials (non-elastic or elastic materials, as desired), so as to have different aerodynamic properties, or improve efficacy, as desired. All such changes and modifications are considered to be within the spirit and scope of the invention.

The invention claimed is:

1. An elastic resistance band for an exercise device, said band comprising;

a center portion comprised of a flexible sheet-like material having opposed ends; and two elastic resistance band portions, each portion having first and second opposed ends, where the first end of a respective one of the elastic resistance band portions is attached to a respective one of the opposed ends of the center portion, and the second end of a respective one of the elastic resistance band portions is attached to a fastening means for attaching the elastic resistance band portion to an exercise device, wherein:

said center portion has a generally rectangular shape with a first dimension along its length, a second dimension along its width and a longitudinal axis along its center, and where each of the opposed ends of the center portion are gathered together where they are attached to a respective one of said elastic resistance band portions, in a manner so as to shorten said second dimension by an equal amount about said longitudinal axis, so as to cause, in combination with the width to length aspect ratio of said generally rectangular shaped center portion, said sheet-like material to have a tendency to billow in the air and form a cup-shape upon rapid movement of said center portion through air, said center portion thereby presenting a substantial friction against air so to create a wind resistance effect which will significantly slow down movement of the center portion in the event the center portion is forced to move rapidly through air, thereby creating a safety brake for said center portion and reduce the likelihood of injury to a user of the exercise device.

2. The resistance band device of claim 1, where the width to length ratio of said generally rectangular shaped center portion is approximately 1:5.

3. The resistance band device of claim 1, where the width to length ratio of said generally rectangular shaped center portion is in the range of 1:5 to 1:3.

4. The resistance band device of claim 1, where the width to length ratio of said generally rectangular shaped center portion is in the range of about 6 inches to about 12 inches, and the length of said generally rectangular shaped center portion is about 30 inches.

5. The resistance band device of claim 1, where said fastening means attaches the second end of each of said elastic resistance band portions to a handle adapted to be grasped by the hand of a user of the exercise device.

6. The resistance band device of claim 1, where said fastening means attaches the second end of each of said elastic resistance band portions to opposite ends of a bar adapted to be grasped by the hands of a user of the exercise device.

7. The resistance band device of claim 1, where the generally rectangular shaped center portion is comprised of an air impervious type of material.

8. The resistance band device of claim 1, where the generally rectangular shaped center portion is comprised of a parachute type of material.

9. The resistance band device of claim 1, where the generally rectangular shaped center portion is comprised of a netting type of material.

10. The resistance band device of claim 1, where the fastening means comprises a knot formed in the elastic resistance band portion.

11. An elastic resistance band exercise device, comprising;

a center portion comprised of a flexible sheet-like material having opposed ends; and two elastic resistance band portions, each portion having first and second opposed ends, where the first end of a respective one of the elastic resistance band portions is attached to a respective one of the opposed ends of the center portion, and the second end of a respective one of the elastic resistance band portions is attached to a fastening means for attaching the elastic resistance band portion to an exercise device, wherein:

said center portion has a generally rectangular shape with a first dimension along its length, a second dimension along its width and a longitudinal axis along its center, and where each of the opposed ends of the center portion are gathered together where they are attached to a respective one of said elastic resistance band portions, in a manner so as to shorten said second dimension by an equal amount about said longitudinal axis, so as to cause, in combination with the width to length aspect ratio of said generally rectangular shaped center portion, said sheet-like material to have a tendency to billow in the air and form a cup-shape upon rapid movement of said center portion through air, said center portion thereby presenting a substantial friction against air so to create a wind resistance effect which will significantly slow down movement of the center portion when the center portion is forced to move rapidly through air, thereby creating a safety brake for said center portion and reduce the likelihood of injury to a user of the exercise device.

12. The resistance band device of claim 11, where the width to length ratio of said generally rectangular shaped center portion is approximately 1:5.

13. The resistance band device of claim 11, where the width to length ratio of said generally rectangular shaped center portion is in the range of 1:5 to 1:3.

14. The resistance band device of claim 11, where the width to length ratio of said generally rectangular shaped center portion is in the range of about 6 inches to about 12 inches, and the length of said generally rectangular shaped center portion is about 30 inches.

15. The resistance band device of claim 11, where said fastening means attaches the second end of each of said elastic resistance band portions to a handle adapted to be grasped by the hand of a user of the exercise device.

16. The resistance band device of claim 11, where said fastening means attaches the second end of each of said elastic resistance band portions to opposite ends of a bar adapted to be grasped by the hands of a user of the exercise device.

17. The resistance band device of claim 11, where the generally rectangular shaped center portion is comprised of an air impervious type of material.

18. The resistance band device of claim 11, where the generally rectangular shaped center portion is comprised of a parachute type of material.

19. The resistance band device of claim 11, where the generally rectangular shaped center portion is comprised of a netting type of material.

20. The resistance band device of claim 11, where the fastening means comprises a knot formed in the elastic resistance band portion.

21. A method for reducing the tendency of an restrained end of an elastic resistance band portion of an exercise device to rapidly move through the air if the restrained end is suddenly released from being restrained, comprising the following steps:

connecting opposed ends of a flexible sheet-like material having a substantially rectangular shape to a restrained end of an elastic resistance band portion of an exercise device;

connecting an opposed end the elastic resistance band portion of the exercise device to a fastening means for attaching the elastic resistance band portion to the exercise device; and gathering each of the opposed ends of the flexible sheet-like material together where they are connected to said restrained end of the elastic resistance band portion of the exercise device, so as to cause said substantially rectangular shaped sheet-like material to have a tendency to billow in the air and form a cup-shape upon rapid movement of said flexible sheet-like material through air, said flexible sheet-like material thereby presenting a substantial friction against air so to create a wind resistance effect which will significantly slow down movement of restrained end if it is suddenly released from being restrained and thereby caused to move rapidly through air, said flexible sheet-like material thereby creating a safety brake for the elastic resistance band portion of the exercise device which will reduce the likelihood of injury to a user of the exercise device upon sudden release of said restrained end.

22. The method of claim 21, including the further steps of:

providing two elastic resistance band portions for said exercise device, coupling one end of each elastic resistance band portion to the exercise device; and coupling an opposed end of each elastic resistance band portion to said flexible sheet-like material, so that said flexible sheet-like material forms a central portion of an elastic resistance band assembly which is coupled to the exercise device.

* * * * *